US005142583A

United States Patent [19]

Galand et al.

[11] Patent Number: 5,142,583

[45] Date of Patent: Aug. 25, 1992

[54] LOW-DELAY LOW-BIT-RATE SPEECH CODER

[75] Inventors: Claude Galand; Jean Menez, both of Cagnes Sur Mer, both of France

[73] Assignee: International Business Machines Corporation, Armonk, N.Y.

[21] Appl. No.: 522,710

[22] Filed: May 14, 1990

[30] Foreign Application Priority Data

Jun. 7, 1989 [EP] European Pat. Off. ..... 89480098.6

[51] Int. Cl.[5] ..... G10L 9/08

[52] U.S. Cl. ..... 381/38; 381/36

[58] Field of Search ..... 381/29-41, 381/49; 364/513.5; 375/25, 122

[56] References Cited

U.S. PATENT DOCUMENTS 4,752,956 6/1988 Sluijter ..... 381/49
4,757,517 7/1988 Yatsuzuka ..... 375/122
4,924,508 5/1990 Crepy et al. ..... 381/38
4,933,957 6/1990 Bottau et al. ..... 381/29
4,965,789 10/1990 Bottau et al. ..... 375/27

OTHER PUBLICATIONS

IBM TDB, vol. 29, No. 2, Jul. 1986, pp. 929-930 "Multipulse Excited Linear Predictive Coder".

ICASSP 86 (IEEE-IECEJ-ASJ) Int. Conf. on Acoustics, Speech & Signal Processing, Apr. 7-11, 1986, vol. 3, pp. 1693-1696.

*Primary Examiner*—Michael R. Fleming
*Assistant Examiner*—Michelle Doerrler
*Attorney, Agent, or Firm*—Joscelyn G. Cockburn

[57] ABSTRACT

A vector quantizing speech coder includes a Short-Term-Predictive filter which receives originally sampled speech signal s(n) and decorrelates it into a residual signal r(n). A device is provided to quantize the residual signal r(n) at a low bit rate. The device also generates a reconstructed signal r(n) from which coefficients for adjusting the Short-Term-Predictive filter are dynamically derived.

11 Claims, 4 Drawing Sheets

LOW-DELAY LOW-BIT-RATE SPEECH CODER

This invention deals with digital speech coding and more particularly with coding schemes providing a low coding delay while using block coding techniques enabling lowering the coding bit-rate.

BACKGROUND OF INVENTION

Low-bit-rate speech coding schemes have been proposed wherein the flow of speech signal samples, originally coded at a relatively high bit-rate, is split into consecutive blocks of samples, each block being then re-coded at a lower bit rate using so called Vector Quantizing (VQ) techniques. VQ techniques include for instance so called Pulse-Excited (RPE or MPE) as well as Code Excited Coding. More efficient coding has also been achieved by combining Vector Quantizing with Linear Predictive Coding (LPC) wherein bandwidth compression is performed over the original signal prior to performing the VQ operations. To that end, the speech signal is first filtered through a vocal tract modeling filter. Said filter (Short Term-Predictive (STP) filter) is designed to be a time invariant, all-pole recursive digital filter, over a short time segment (typically 10 to 30 ms, corresponding to one or several blocks of samples). This supposes first an LPC analysis over said short time segment to derive the filter coefficients, i.e. prediction coefficients, characterizing the vocal tract transfer function. Then the time-variant character of speech is handled by a succession of such filters with different parameters, i.e. by dynamically varying the filter coefficients.

Filter coefficients derivation operation obviously mean processing delay adding to the otherwise coding delay due to further processing including VQ operations. This leads to total delay in the order of 25 to 80 ms depending on the type of signal processor being used.

Such a delay is not compatible with the specifications of speech coders to be used in the public switched network without echo cancellation. More particularly, no known technique fits to a low bit rate (e.g. 16 kbps) which would provide a low delay, while still keeping high coding speech quality, with an acceptable coder complexity.

SUMMARY OF INVENTION

One object of this invention is to provide a low-delay low-bit rate speech coder with minimal coder complexity.

More particularly, the present invention addresses a low-delay vector quantizing speech coder wherein the original signal prior to being vector quantized is first decorrelated into a residual (excitation) signal using a short-term adaptive predictive filter the coefficients of which are dynamically derived from a reconstructed residual (excitation) signal.

Further objects, characteristics and advantages of the present invention will be explained in more details in the following, with reference to the enclosed drawings which represent a preferred embodiment thereof.

DETAILED DESCRIPTION OF THE PREFERRED EMBODIMENT

Figure 1:
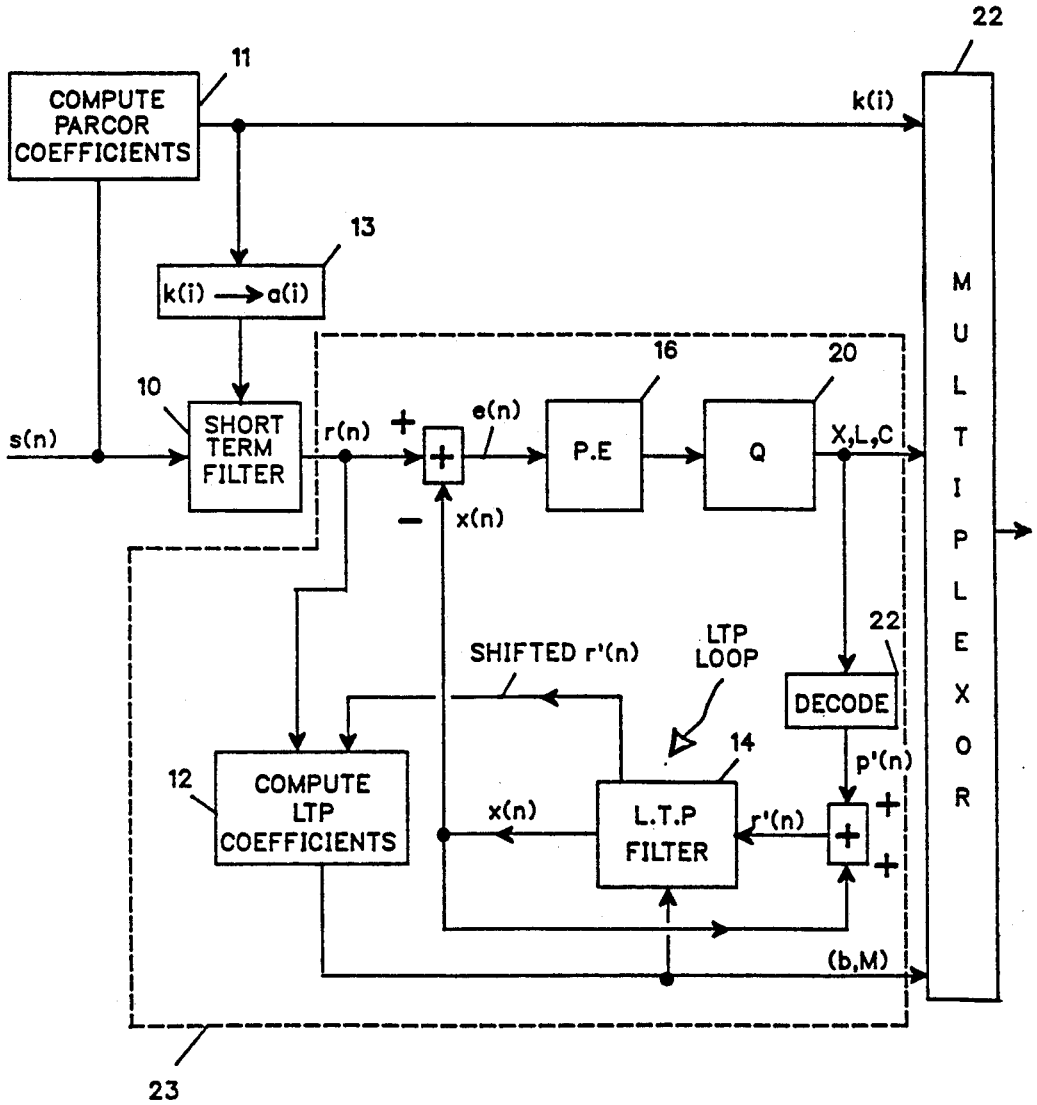
FIG.1 PRIOR ART
FIG. 1 is a prior art coder.

FIG. 1 represents a block diagram of an Adaptive Vector-Quantizing/Long-Term-Predictive (VQ/LTP) coder as disclosed in copending European Application 0280827. Briefly stated one may note that once the original speech signal s(n) sampled and coded at a high bit rate into a device (not shown) has been decorrelated, through an adaptive Short-Term-Predictive filter the coefficients of which are sequentially derived from blocks of s(n) signal samples, into a residual signal r(n), said r(n) is not directly submitted to Vector Quantizing into the Pulse-Excited (P.E.) coder.

The r(n) signal is first converted into an error residual signal e(n). The e(n) signal is then Vector Quantized, to improve the VQ bits allocations. The signal e(n) is derived from r(n) by subtracting therefrom a predicted residual signal x(n) synthesized using a Long-Term-Predictive (LTP) loop.

The LTP loop includes an LTP filter the coefficients (b and M) of which are dynamically derived in a device (12).

In summary, one may note that once the original signal s(n) has been decorrelated into r(n), said r(n) is then coded at a lower rate into a device (23).

For the purpose of this invention, one should note that the Short-Term Filter (10) coefficients (ki's or ai's) are derived and adapted over 20 ms long blocks of s(n) samples. The subsequent coding process is therefore delayed accordingly.

As already mentioned, the resulting overall delay may be incompatible with the limits of coding specifications for some applications.

Figure 2:
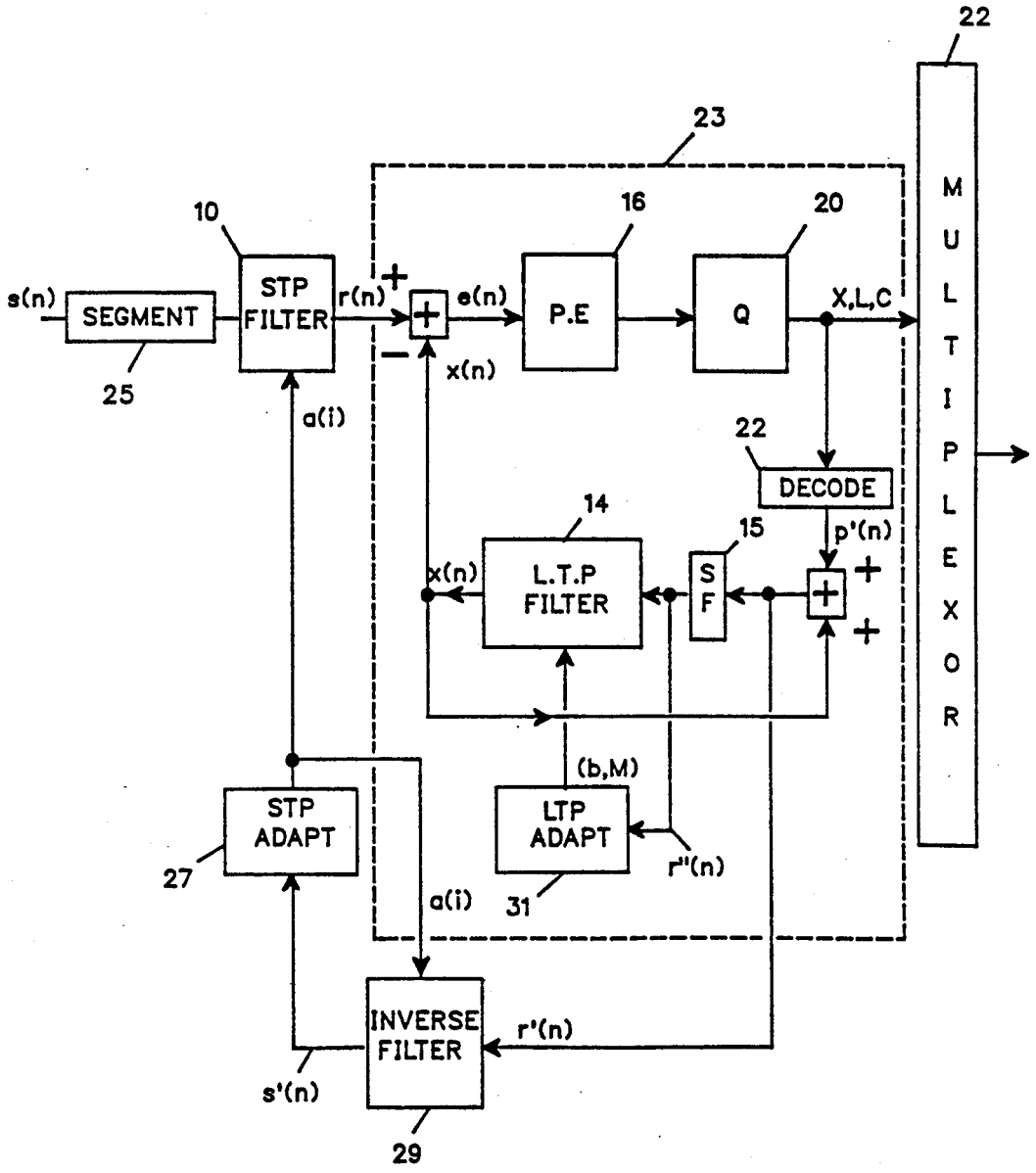
FIG. 2 is a block diagram of an improved coder as provided by this invention.

Represented in FIG. 2 is an improved coder wherein coding bits are saved by not including b, M and ki's into the coded signal, and furthermore by shortening the coding delay involved in the ki's computation. To that end, the s(n) flow of samples is first segmented and buffered (in device 25) into 1 ms long blocks (8 samples/block). The segmented s(n) signal is then decorrelated into the STP filter (10). The STP transfer function of which, in the z domain, is made to be:

$$\frac{A(z)}{A(z/g)} \tag{1}$$

Wherein g is a weighting factor. For instance, g=0.8. In the preferred embodiment an 8th order filter has been used, the ai (i=0, . . . ,8) coefficients of which are derived in a Short-Term-Predictive (STP) adapting device (27) to be described later on.

The STP filter (10) converts each eight samples long block of s(n) signal into r(n), with:

$$r(n) = \sum_{i=0}^{8} a(i) \cdot s(n-i) - \sum_{i=1}^{8} c(i) \cdot r(n-i) \tag{2}$$

with:

$n=1, \ldots, 8$ $c(i)=a(i) \cdot g^{i}$ $i=1, \ldots, 8$

The STP filter (10) is adapted every ms, i.e. at each new block of 8 samples r'(n) using a feedback block technique. To that end, the reconstructed excitation (or residual) signal r'(n) is first filtered through a weighted vocal tract filter or inverse filter (29), the transfer function of which is:

$$\frac{A(z/g)}{A(z)} \tag{3}$$

providing also noise shaping through use of a weighting coefficient g=0.8. Said inverse filter (29) thus provides a reconstructed speech signal s'(n).

The signal s'(n) is given by:

$$s'(n) = \sum_{i=0}^{8} c(i) \cdot r'(n-i) - \sum_{i=1}^{8} a(i) \cdot s'(n-i) \tag{4}$$

$$n = 1, \ldots, 8$$

$$\text{with: } c(i) = a(i) \cdot g^i \; i = 1, \ldots, 8$$

The resulting set of 8 samples s'(n), (n=1, . . . 8) is then analyzed in an STP Adapt device (27) as follows.

A 160 samples long block (20 ms) is generated by concatenating the 8 currently derived s'(n) samples (n=1, . . . 8) with the previously reconstructed samples s'(n−i) for i=0, . . . ,151, stored into a delay line (not shown) within device (27).

Then, an 8th order autocorrelation analysis is carried out over the 20 ms long block by computing:

$$R(k) = \sum_{n=-151}^{8} s'(n) \cdot s'(n-k) \tag{5}$$

for k=0, . . . ,8

The expression (5) may be evaluated recursively from one block to the next, as follows:

Let's denote R1(k); (k=0, . . . ,8) the set of autocorrelation coefficients computed through equation (5) over a 1 ms block. Let's denote R2(k); (k=0, . . . ,8) the next 1 ms block. One can write:

$$R1(k) = \sum_{n=-151}^{8} s'(n) \cdot s'(n-k) \text{ for } k = 0, \ldots 8 \tag{6}$$

$$R2(k) = \sum_{n=-144}^{16} s'(n) \cdot s'(n-k) \text{ for } k = 0, \ldots 8 \tag{7}$$

Then:

$$R2(k) = R1(k) + \sum_{n=9}^{16} s'(n) \cdot s'(n-k) - \sum_{n=-151}^{-144} s'(n) \cdot s'(n-k) \tag{8}$$

Therefore valuable processing load may be saved by applying the following algorithm for iterative determination of R(k)'s:

Consider an array T(k,N); k=0, . . . ,8; N=0, . . . ,20 to store partial correlation products.

For each new set of samples s'(n); n=1, . . . ,8 compute and store:

$$T(k,0) = \sum_{n=1}^{8} s'(n) \cdot s'(n-k) \tag{9}$$

for k=k=0, . . . ,8

From the previously computed auto-correlation R(k), compute:

$$R(k) = R(k) + T(k,0) - T(k,20) \tag{10}$$

for k=0, . . . ,8

Shift array $$T(k,N) = T(k,N-1) \tag{11}$$

for N=20, . . . ,1 and k=0, . . . ,8

This algorithm just requires storing the set of autocorrelation coefficients R(k) computed using last 1 ms block; and only computing partial autocorrelation coefficients to be stored into a 189 (i.e. 9×21) positions array T. The shifting within array T can be implemented through modulo addressing.

Conversion of autocorrelation R(k) coefficients into a(i) filter coefficients may be achieved through use of Leroux-Guegen algorithm (which is a fixed point version of the Levinson algorithm). For further details one may refer to J. Leroux, C. Gueguen: "A fixed point computation of partial correlation coefficients", IEEE Transaction ASSP, pp.257–259, June 1977. The a(i) coefficients are used to tune both filters (10) and (29).

One may also note that in the improved coder of FIG. 2, the LTP loop includes a smoothing filter (15), the transfer function of which is, $SF(z)=0.91+0.17\,z^{-1}-0.08\,z^{-2}$ which derives a smoothed reconstructed residual signal r''(n) from the reconstructed residual signal r'(n). Said r''(n) is then used to derive the LTP parameters (b, M) every millisecond (ms) into a device (31). This is achieved by computing:

$$R(k) = \sum_{n=1}^{24} r''(n) \cdot r''(n-k) \text{ for } k = 20, \ldots, 100$$

Then M is selected as being the k parameter for the largest R(k) in absolute value. And $$b = R(M) / \sum_{n=1}^{24} r''(n-M)$$

Finally, the LTP filter is also fed with r''(n) rather than r'(n).

Figure 3:
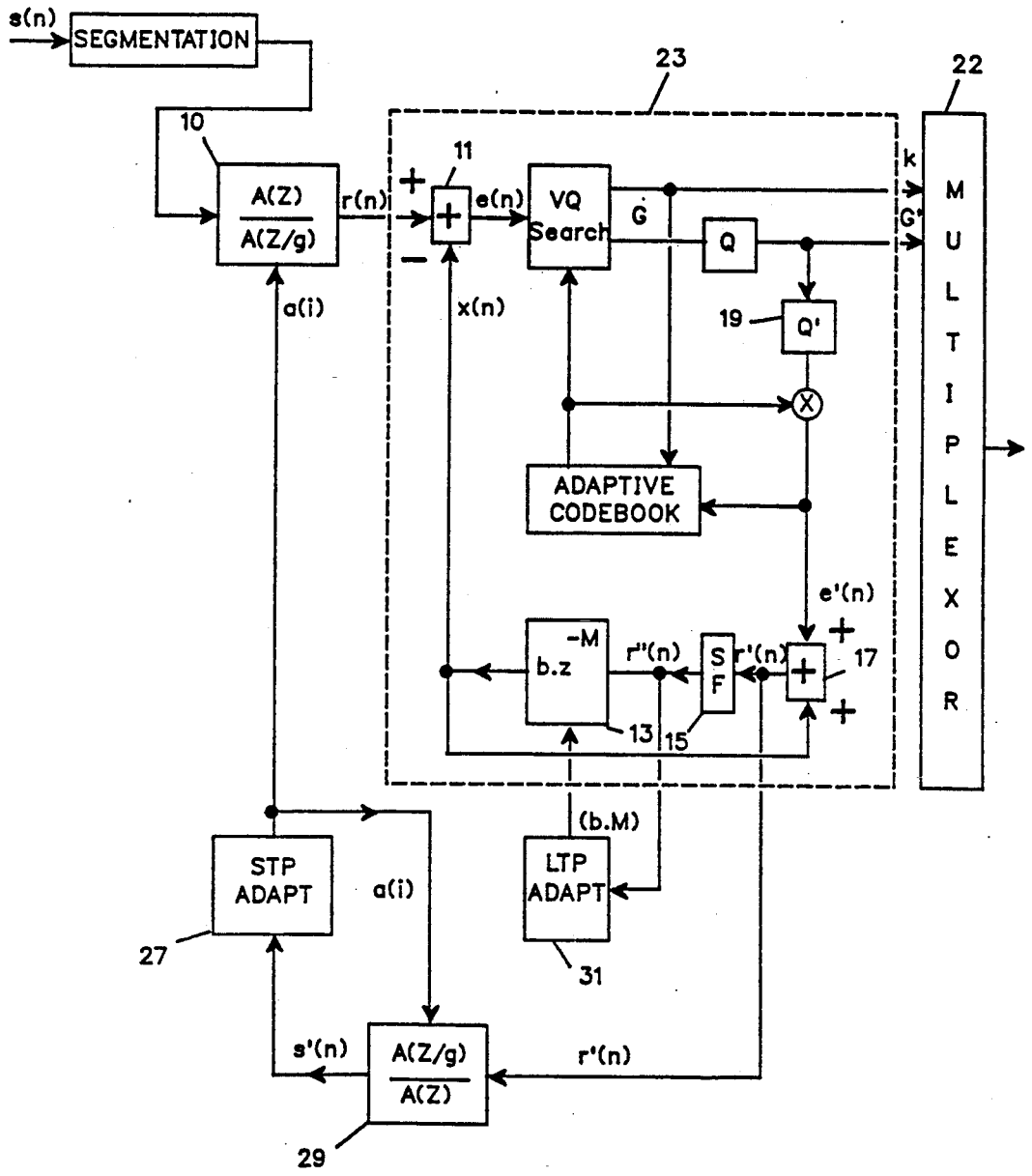
FIG. 3 shows another implementation of the invention.

As represented in FIG. 3, further improvement to the above described coding scheme may be achieved by using an Adaptive-Code Excited Linear Predictive Coder (A-CELP) for performing the Vector-Quantizing operations, as described in Copending Application (88480060.8).

Figure 4:
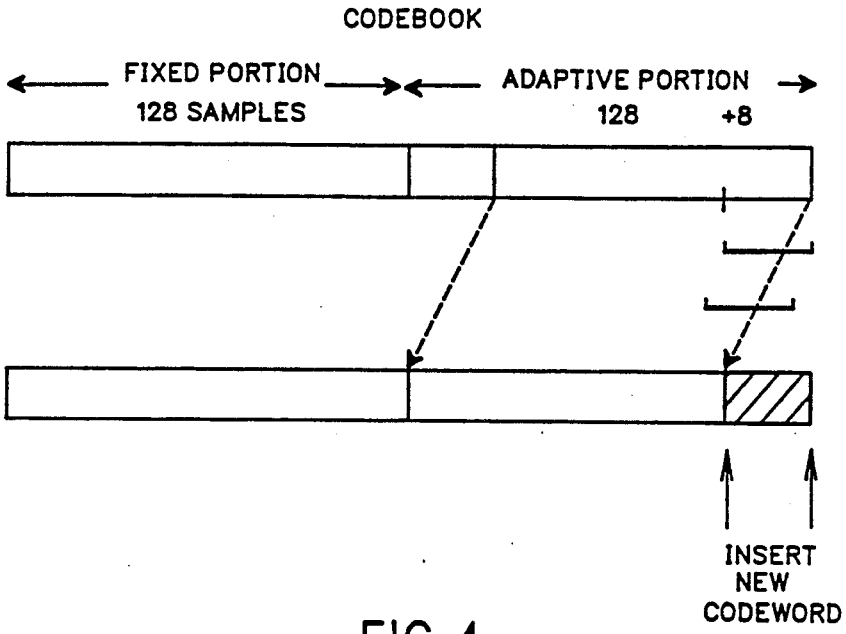
FIG. 4 is a representation of an adaptive method to be used with the coder of FIG. 3.

Assuming first that codewords are stored into a table, CELP coding means selecting a codebook index k (address of codeword best matching the e(n) sequence being considered) and a gain factor G. The gain G is quantized with five bits (in a device Q). The codebook table is made adaptive. To that end, a 264 samples long codebook is made to include a fixed portion (128 samples) and an adaptive portion (136 samples), as represented in FIG. 4.

The stored codebook samples are denoted CB(i); (i=0, . . . 263). The sequence CB(i) is pre-normalized to a predefined constant C, i.e.:

$$\sum_{n=1}^{8} CB^2(n+k) = C \tag{12}$$

for all k=0, . . . ,255.

Then, given a set of eight e(n) samples, codebook search is performed by:

computing $$R(m) = \sum_{n=1}^{8} e(n) \cdot CB(n+m-1) \tag{13}$$

for m=0, . . . ,255 selecting k such that:

$$R(k) = \max_{n=0}^{255} |R(m)| \tag{14}$$

computing the gain factor G according to:

$$G = R(k)/C \tag{15}$$

An improvement in the quantization of the gain G can be achieved by selecting the best sequence of the code-book according to a modified criterion replacing relation (14) by:

$$R(k) = \max_{n=0}^{255} R(m),\ R(m) < 4 \cdot R'(k) \tag{14a}$$

where R'(k) represents the maximum selected at the previous block of samples.

Relation (14a) simply expresses that the gain G of the vector quantizer is constrained to variations in a ratio of 1 to 4 from one block to the following. This allows savings of at least one bit in the quantization of this gain, while preserving the same quality of coding.

The corresponding gain G needs being quantized into G' in a device Q. Therefore, to limit any quantizing noise effect on any subsequently decoded speech signal, a dequantizing operation (Q') is performed over G' prior to computing e'(n).

$$e'(n) = G \cdot CB(n+k-1) \text{ for } n=1, \ldots, 8. \tag{16}$$

The codebook is adapted according to the following relations:

$$CB(i) = CB(i+8) \text{ for } i=127, \ldots 255 \tag{17}$$

$$CB(255+i) = \mathrm{NORM}(CB(n+k-1)) \text{ for } i=1, \ldots, 8 \tag{18}$$

where NORM denotes the normalization operator:

$$NORM(x(i)) = x(i) \cdot SQRT\left( C / \sum_{j=1}^{8} x^2(j) \right) \tag{19}$$

with SQRT denoting the square root function.

The LTP parameters (b,M) are computed every millisecond (ms) in LTP Adapt (31), i.e. at each new block of eight samples r'(n). For that purpose r'(n) is first filtered into a smoothing filter (15) as already disclosed with reference to FIG. 2. The filter (15) provides a smoothed reconstructed residual signal r''(n). Then, the autocorrelation function R(n) of the smoothed reconstructed excitation signal is computed through:

$$R(k) = \sum_{n=1}^{24} r''(n) \cdot r''(n-k) \tag{20}$$

is evaluated for k=20, . . . ,100

In practice, computing load may be saved by evaluating this autocorrelation function recursively from one block to the next as already recommended for equation (5).

The optimum delay M is determined as the maximum absolute value of this function:

$$R(M) = \max(|R(k)|);\ k=20, \ldots, 100). \tag{21}$$

The corresponding gain b is derived from:

$$b = R(M) / \sum_{n=1}^{24} r'(n-M)$$

Figure 5:
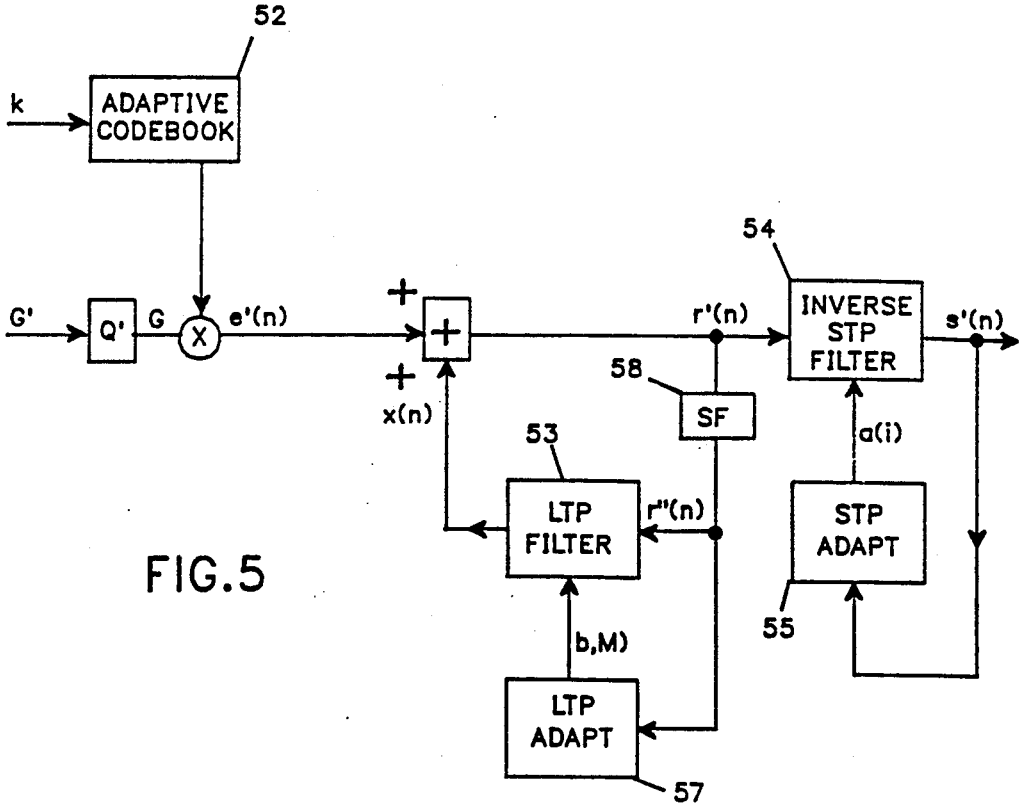
FIG. 5 is a decoder to be used in conjunction with the coder of FIG. 3.

Represented in FIG. 5 is a block diagram of the decoder for synthesizing the speech signal back from k and G' data. Initially, both coder and decoder codebook are identically loaded and they are subsequently adapted the same way. Therefore k is now used to address the codebook and fetch a codeword therefrom. By multiplying said codeword with a dequantized gain factor G one gets a reconstructed e'(n). Adding e'(n) to a reconstructed residual signal x(n), provided by an LTP filter (53), leads to r'(n), which, once filtered into a smoothing filter SF (58) with the transfer function $SF(Z) = 0.91 + 0.17.Z^{-1} - 0.08.Z^{-2}$ gives a signal r''(n). The signal r'(n), filtered into an inverse STP filter (54) leads to a synthesized speech signal s'(n).

The STP filter equation in the z-domain is:

$$\frac{A(z/g)}{A(z)}$$

It is to be noticed that neither the STP filter a(i) coefficients, nor the LTP parameters (b,M) have been inserted into the coded speech signal.

These data need therefore be computed in the decoder. These functions are achieved by STP adapter (55) and LTP adapter (57), both similar to adaptors (27) and (31) respectively.

We claim:

1. A speech coder comprising:

a circuit means coupled to receive coefficients a(i) and to generate a low-bit-rate coded residual signal from an original signal S(n);

first synthesizing means sensitive to said low-bit-rate coded residual signal for synthesizing a reconstructed residual signal r'(n);

inverse filter means sensitive to said reconstructed residual signal r'(n) for generating a reconstructed speech signal s'(n) and short term predictive (STP) adapting means, sensitive to said reconstructed speech signal for deriving the coefficients a(i) for tuning said circuit means.

2. A speech coder according to claim 1 wherein said derived sets of coefficients are also used to tune said inverse filter means.

3. A speech coder according to claim 1 or 2 wherein said circuit means includes an adaptive short-term-predictive (STP) filter; a Vector Quantizing Long Term Predictive (VQ/LTP) coder coupled to the (STP) filter; said Vector Quantizing Long Term Predictive (VQ/LTP) coder including:

a Long-Term Predictive loop sensitive to the reconstructed residual signal r'(n) for deriving therefrom a predicted residual x(n) signal;

subtracting means for subtracting said predicted residual signal x(n) from a residual signal r(n) for deriving an error residual signal e(n) therefrom; and, Vector Quantizing means sensitive to e(n) signal blocks of samples for converting said blocks of samples into lower bit rate data using Vector Quantizing techniques.

4. A speech coder according to claim 3 wherein said Vector Quantizing means include Pulse Excited Coding means.

5. A speech coder according to claim 3 wherein said Vector Quantizing means include Code-Excited Linear Predictive coding means.

6. A speech coder according to claim 3 wherein said Long-Term-Predictive loop includes:

a smoothing filter sensitive to r'(n) for deriving a smoothed reconstructed residual r''(n) therefrom;

a LTP adapting means sensitive to the reconstructed residual signal r''(n) for deriving tuning parameters b and M where b represents gain and M represents optimum delay; and, a Long-Term-Predictive (LTP) filter the transfer function of which is, in the z domain, equal to $b.z^{-M}$, connected to said LTP adapting means.

7. A speech coder according to claim 1 wherein said STP adapting means include:

concatenating means for concatenating currently generated reconstructed speech signal samples s'(n) with previously reconstructed samples s'(n−i) wherein i is a predefined integer number;

autocorrelation analysis means sensitive to said concatenating means for deriving autocorrelation coefficients R(k) therefrom; and, conversion means for converting said autocorrelation coefficients R(k) into a(i) filter coefficients, whereby said a(i) coefficients are used to tune said circuit means.

8. A speech coder according to claim 7 wherein said autocorrelation analysis means include computing means for computing the autocorrelation coefficients R(k) according to:

$$R(k) = \sum_{n=-151}^{8} s'(n) \cdot s'(n-k)$$

for k=0, . . . ,8.

9. A speech coder according to claim 8 wherein said autocorrelation analysis means include:

a memory array T(k,N); k=0, . . . ,8; N=0, . . . ,20 for storing partial correlation products;

first computing means sensitive to each newly generated set of s'(n) samples for computing and storing into said memory array;

$$T(k,0) = \sum_{n=1}^{8} s'(n) \cdot s'(n-k)$$

for k=0, . . . ,8.

second computing means for deriving new R(k) from previous R(k), i.e. R(k) old according to:

$$R(k)\ \text{new} = R(k)\ \text{old} + T(k,0) - T(k,20)$$

for k=0, . . . ,8.

shifting means for shifting said memory array contents according to:

$$T(k,N) = T(k,N-1)$$

for N=20, . . . , 1 and k=0, . . . ,8.

10. A speech coder according to claim 9, wherein said shifting means includes modulo addressing means.

11. A circuit arrangement for use in a low-delay low bit-rate speech coder having an adaptive Short-Term-Predictive (STP) filter for receiving original speech signal s(n) and coefficients a(i), originally sampled and coded at a high bit rate and decorrelating said original speech signal s(n) into a low-bit-rate coded residual signal, said circuit arrangement comprising:

first synthesizing means sensitive to said low-bit-rate coded residual signal for synthesizing a reconstructed residual signal r'(n);

inverse filter means sensitive to said reconstructed residual signal r'(n) for generating a reconstructed speech signal s'(n); and, STP adapting means, sensitive to said reconstructed speech signal for deriving the coefficients a(i).

* * * * *